United States Patent [19]

Ernest

[11] 4,410,828

[45] Oct. 18, 1983

[54] JACKETED LAMP HAVING TRANSVERSE ARC TUBE

[75] Inventor: Paul W. Ernest, Cleveland Hts., Ohio

[73] Assignee: General Electric Company, Schenectady, N.Y.

[21] Appl. No.: 271,505

[22] Filed: Jun. 8, 1981

[51] Int. Cl.[3] ..... H01J 61/52; H01K 1/58

[52] U.S. Cl. ..... 313/25; 313/26; 313/312

[58] Field of Search ..... 313/25, 26, 27, 312

[56] References Cited

U.S. PATENT DOCUMENTS

| | | | |
|---|---|---|---|
| 2,901,648 | 8/1959 | Linsday et al. | 313/25 |
| 4,142,122 | 2/1979 | Koza | 313/25 X |
| 4,341,975 | 7/1982 | Phillipp et al. | 313/25 |

*Primary Examiner*—Palmer C. Demeo
*Assistant Examiner*—Sandra L. O'Shea
*Attorney, Agent, or Firm*—John P. McMahon; Philip L. Schlamp; Fred Jacob

[57] ABSTRACT

Transverse mounting of the arc tube within the lamp jacket is effected through a mount featuring a hinged self-latching attachment of the arc tube to a support rod extending the length of the jacket and serving also as electrical connector to one electrode. A flexible connector makes connection to the other electrode. During manufacture the hinges permit the arc tube to be folded in line with the support rod for passage through the neck and then to be transversely erected in the jacket, and the latch thereupon locks the arc tube in the transverse attitude.

6 Claims, 2 Drawing Figures

JACKETED LAMP HAVING TRANSVERSE ARC TUBE

The invention relates to a high intensity discharge lamp comprising an arc tube transversely mounted in an outer envelope or glass jacket, and is particularly concerned with the mounting arrangement.

BACKGROUND OF THE INVENTION

The invention is especially useful with metal halide arc discharge lamps used for general illumination which comprise an arc tube of quartz or fused silica having electrodes at each end and containing a fill of mercury, metal halide and an inert gas for starting purposes. In common with most high intensity discharge lamps used for general illumination, such lamps are provided with an outer envelope or jacket made of glass which encloses the arc tube. The jacket is either evacuated or filled with an inactive gas and keeps air away from the seals and metal inleads which otherwise would oxidize at the operating temperature. It gives mechanical protection, and serves as a heat conservator and as a short wave ultraviolet filter. The jacket generally comprises a bulbous or ellipsoidal main portion which is extended at one end into a tubular neck portion to which is attached a screw type base for accommodating the lamp in a standard socket. The common practice has been to mount the arc tube axially within the jacket and this of course facilitates passing the arc tube mount or frame through the neck in lamp manufacture.

Vertical operation of the arc tube is the preferred mode resulting in higher efficiency and longer life. The discharge in a metal halide lamp is a constricted arc which extends along the axis or midline of the arc tube so long as the arc tube is vertical. If the arc tube is inclined out of the vertical, and all the more so if it is made horizontal, internal convection currents affect the discharge and displace it from the axis. In a horizontal arc tube, the discharge is bowed up and may even contact the upper wall. This means that part of the arc tube where the discharge is in close proximity to the upper wall is overheated while the lower extremities are underheated. The partial overheating is responsible for poorer maintenance and shorter life, while the partial underheating reduces the vapor pressure of the metal halides and causes lower efficacy and poorer color rendition. The end result is that efficacy and life are reduced from 10 to 15% when a conventional metal halide lamp is operated with the arc tube horizontal instead of vertical.

While vertical operation is most common, there are many installations wherein considerations of space or convenience and economy require that the outer envelope of the lamp be mounted horizontally. In recent years, primarily as a result of improvements in color rendition, metal halide lamps have found increasing use indoors and in applications where the ceiling height is limited. Fixtures for such applications mount the outer envelope horizontally in order to save space. This has increased the demand for metal halide lamps able to operate without reduction in efficacy or life when the outer envelope is horizontal.

Mounting the arc tube transversely to the axis of the jacket is difficult because the arc tube is longer than the diameter of the neck. One scheme for so doing which is currently in commercial use is described and claimed in copending application Ser. No. 158,932 filed June 12, 1980 by Phillipp et al, now U.S. Pat. No. 4,341,975, and assigned to the same assignee as the present invention. It involves inserting into the jacket a folded incompletely assembled mount assembly in which the arc tube is hinged to a long support rod extending from the stem, and a short support rod trails from the arc tube. After insertion, the arc tube is transversely erected and the short rod is welded inside the jacket to its lead-in wire sealed through the stem. In smaller sizes of lamp, the jacket has a narrower neck and that makes interior welding extremely difficult. Also when this scheme is used with lamps in which the jacket is internally coated with a phosphor or diffuser, a careless operator may scratch the coating badly.

SUMMARY OF THE INVENTION

The object of the invention is to provide an improved transverse mounting of the arc tube in a jacketed high intensity discharge lamp whereby the arc tube may be vertical when the lamp is supported horizontally. A mounting arrangement is sought which overcomes the limitations of the Phillipp et al scheme and which is reliable, economical to manufacture, requires no special skill in assembling the lamp and is suitable for use with narrow-necked jackets.

In accordance with my invention, transverse mounting of the arc tube in the bulb of a jacketed lamp is effected through a mount featuring a hinged attachment of the arc tube to a support rod which serves also as electrical connector to one electrode. During manufacture the hinges permit the arc tube to be folded substantially in line with the support rod for passage through the neck, and then allow the arc tube to be transversely erected in the bulb. A latch holds the arc tube in its transverse attitude after erection. In a preferred construction a long support rod attached to one inlead at the stem extends the full length of the jacket, curving in proximity to the jacket wall, and is anchored at the dome end. This single rod provides the entire support of the arc tube within the bulb and also serves as conductor to one main electrode. A flexible connector or ribbon serves as conductor to the other main electrode.

DETAILED DESCRIPTION

Figure 1:
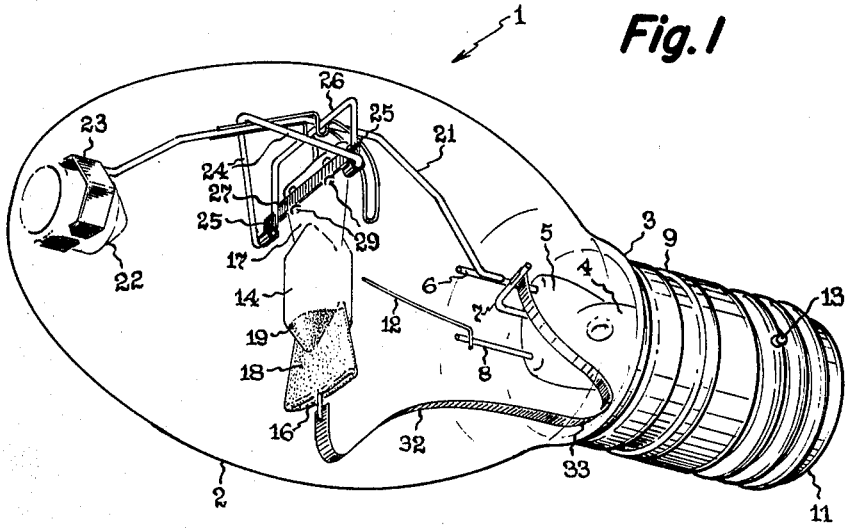
FIG. 1 illustrates a complete jacketed metal halide lamp with transversely mounted arc tube embodying the invention.

Referring to FIG. 1, lamp 1 illustrated therein comprises an outer envelope or jacket of glass comprising a bulb portion 2 and a reduced diameter tubular neck portion 3. In the end of the neck is sealed a re-entrant stem 4 having a press 5 through which extend stiff lead-in wires 6, 7 and 8. To the outer end of the neck is fastened a cylindrical metal shell or collar extender 9 to which is attached a conventional screw base 11. The collar extender allows the base to run at a cooler temperature and permits an electronic starting pulse generator to be located within the base. The pulses are coupled to the arc tube through lead-in wire 8 to which a capacitive probe 12 extending into proximity to the arc tube is attached. Inleads 6 and 7 are connected respectively to the threaded shell and center contact (not shown) of the base 11. A locating pin 13 may be provided on the base shell which strikes a stop in the socket in which the lamp is accommodated after the base has been screwed in almost home. This prevents further rotation of the lamp so that a uniform orientation is achieved making the arc tube upright in all such sockets.

Arc tube 14 is made of quartz or fused silica and contains mercury, metal halides such as NaI, $ScI_3$ and $ThI_4$, and an inert gas such as argon at a low pressure to facilitate starting. The arc discharge takes place between main electrodes (not shown) supported in opposite ends of the arc tube by inleads 15, 16 which include foliated portions hermetically sealed through conventional wide pinch seals 17, 18. A white heat-reflecting coating 19 may be provided on the lower end of the arc tube to make the two ends more nearly equal in temperature notwithstanding convection effects within the arc tube.

In the illustrated embodiment of the invention arc tube 14 is transversely supported in bulbous portion 2 of the jacket through a mount comprising a single support rod 21 welded to stem lead-in wire 6. Rod 21 curves and extends in proximity to the upper wall of the bulb portion all the way to an anchoring dimple 22 at the dome end which it engages by an encircling clip 23. The arc tube is suspended by its upper end approximately below the mid-point of rod 21 by means of a V-shaped wire yoke 24 welded to the rod and having turned ends engaged by sheet metal hinges 25. The hinges are attached to the ends of a three-sided wire frame member 26. The upper flat or pinched end 17 of the arc tube is clamped between metal straps 27, 28 (shown in FIG. 2) which extend between the downturned ends of frame member 26. The arc tube 14 of FIG. 1 is locked in place relative to straps 27, 28 by reason of small embossments 29 raised in the quartz on both sides. These embossments are conveniently formed when the foliated inleads are sealed in by pinching the quartz tube ends. The upper transverse portion of frame member 26 serves as a latch cooperating with notched doubled-wire clasp spring 31 to hold the arc tube transverse.

Figure 2:
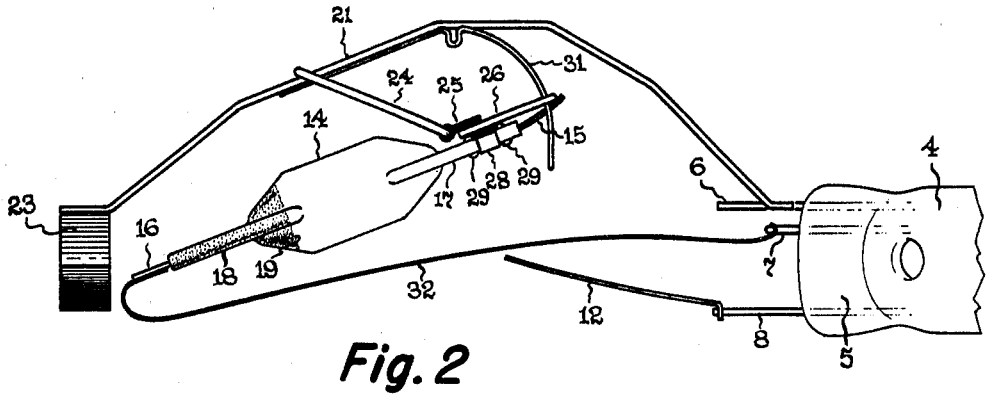
FIG. 2 shows the mount with the arc tube folded forward in line for passage through the neck.

The upper electrode inlead 15 is welded to frame member 26 and electrical connection is made to it through the hinge 25, yoke 24 and support rod 21 to inlead 6. Electrical connection is made to lower electrode inlead 16 by flexible strap 32. The strap is long enough to allow the arc tube to be pivoted forward as shown in FIG. 2, and is welded to the laterally turned end of lead-in wire 7. This permits the excess length of strap to fold up on itself at 33 by the side of the stem 4 without touching any of the other conductors when the arc tube is transversely erected.

The mount assembly comprising stem, arc tube and support structure is completely assembled prior to insertion into the outer envelope or jacket. To insert the assembly into the jacket, the arc tube is pivoted forward as shown in FIG. 2 so that it is substantially aligned with the support rod 21 above it. In the folded condition, the assembly is readily inserted through the neck of the jacket and into the bulb without scratching any coating on the jacket walls. It is advanced until clip 23 engages anchoring dimple 22 of the jacket. A small wand is then inserted into the bulb and used to pivot the arc tube into the transverse attitude and cause the latch to engage the clasp and lock the arc tube in place as shown in FIG. 1. The manufacture of the lamp is then completed in conventional fashion on a sealing machine followed by basing.

The mount structure of my invention has a particular advantage for metal halide lamps. The arc tube filling of such lamps usually includes sodium iodide, and the sodium $Na^+$ ion can migrate through hot quartz, as is well known. Sodium loss from an arc tube has deleterious consequences, and it is encouraged by metal conductors which can emit photoelectrons when irradiated by ultraviolet and which extend along the arc tube close to its walls. My construction provides no such conductors close to the arc tube so that sodium loss from the quartz arc tube is not a problem.

What I claim as new and desire to secure by Letters Patent of the United States is:

1. An electric lamp comprising:

a glass jacket having a bulb portion with a reduced diameter neck portion closed by a stem having at least a pair of lead-in wires sealed therethrough, a base fastened to the end of said neck and having contact members, an arc tube within the bulb portion of greater overall length than the internal diameter of the neck portion, said arc tube having electrodes attached to inleads sealed into opposite ends of the tube, a flexible strap directly interconnecting the inlead at one end of the arc tube with one of the pair of lead-in wires in said stem;

and a mount structure comprising a single rod for providing the support of said arc tube within said bulb portion and extending from the other of said lead-in wires in said stem into the bulb portion, a single hinged attachment of one end of the arc tube to said single support rod, said single hinged attachment constituting the sole means for hingedly supporting said arc tube and allowing folding of said mount structure substantially in line with said single support rod for passage through the neck and thereafter transverse erection of the arc tube within the bulb, and latching means for holding said arc tube in a transverse attitude after erection.

2. A lamp as in claim 1 wherein said support rod extends to and engages the dome end of said bulb.

3. A lamp as in claim 2 wherein said single support rod curves along the wall of said bulb portion and is terminated by a clip which engages an inverted nipple in the dome end of the bulb.

4. A lamp as in claim 1 wherein said hinged attachment comprises a yoke attached to said rod having its ends engaged by hinges fastened to a frame member clamping one end of said arc tube.

5. A lamp as in claim 1 of the metal halide type wherein the arc tube is made of quartz and the filling includes sodium iodide.

6. A lamp as in claim 1 wherein said base includes a collar extender and said lamp further comprising another lead-in wire sealed in said stem having one end coupled to an electronic starting pulse generator locatable in said collar extender, said another lead-in wire having its other end connected to a capacitive probe extending into proximity to said arc tube.

* * * * *